US006643844B2

(12) United States Patent
Morrow et al.

(10) Patent No.: US 6,643,844 B2
(45) Date of Patent: Nov. 11, 2003

(54) LACROSSE GOALIE GLOVE

(75) Inventors: David Morrow, Farmington Hills, MI (US); Jesse Hubbard, Troy, MI (US)

(73) Assignee: Warrior Lacrosse, Inc., Warren, MI (US)

( * ) Notice: Subject to any disclaimer, the term of this patent is extended or adjusted under 35 U.S.C. 154(b) by 0 days.

(21) Appl. No.: 09/908,331

(22) Filed: Jul. 18, 2001

(65) Prior Publication Data

US 2003/0014805 A1 Jan. 23, 2003

(51) Int. Cl.[7] ..... A41D 13/08
(52) U.S. Cl. ..... 2/161.1; 2/16
(58) Field of Search ..... 2/161.1, 16, 20, 2/160, 161.2, 161.3, 161.5, 161.6, 163, 167

(56) References Cited

U.S. PATENT DOCUMENTS

| | | | | |
|---|---|---|---|---|
| D257,909 S | | 1/1981 | Brine | |
| 4,497,073 A | * | 2/1985 | Deutsch | 2/16 |
| 4,677,698 A | * | 7/1987 | Angas | 2/16 |
| 4,930,162 A | * | 6/1990 | Cote | 2/16 |
| 5,237,703 A | | 8/1993 | Brine et al. | |
| 5,488,739 A | | 2/1996 | Cardinal | |
| 5,511,243 A | | 4/1996 | Hall et al. | |
| 5,530,967 A | * | 7/1996 | Cielo | 2/16 |
| 5,787,506 A | * | 8/1998 | Wilder et al. | 2/159 |
| 5,946,720 A | * | 9/1999 | Sauriol | 2/16 |
| 5,983,396 A | * | 11/1999 | Morrow et al. | 144/162.1 |

OTHER PUBLICATIONS

STX Lacrosse Catalog 2000; Gloves.
BRINE Catalog 2000; Glove.

* cited by examiner

*Primary Examiner*—John J. Calvert
*Assistant Examiner*—Katherine Moran
(74) *Attorney, Agent, or Firm*—Artz & Artz, PC

(57) ABSTRACT

A lacrosse goalie glove has a cuff portion for engaging at least a portion of a wearer's forearm and a hand portion coupled to the cuff portion. The hand portion has a palm portion, an opposing backside portion, an inner side portion, and an outer side portion. The hand portion has a plurality of finger portions secured to and extending therefrom for receipt of a wearer's fingers. The hand portion has a thumb portion secured to and extending therefrom. The hand portion has a flange portion extending from the outer side portion thereof.

37 Claims, 5 Drawing Sheets

70
72
74
78
76
60
54

LACROSSE GOALIE GLOVE

TECHNICAL FIELD

The present invention relates generally to a lacrosse goalie glove and, more particularly, to a lacrosse goalie glove that provides an increased blocking area and thus allows for improved deflection of a lacrosse ball.

BACKGROUND OF THE INVENTION

In contact sports, such as lacrosse or hockey, where sticks are essential elements of the game, a player's hands and wrists are especially vulnerable to injury when being checked by another player's stick. For this reason, players typically utilize padded gloves to protect their hands, wrists and lower forearms during play. The areas of a player's hand that are particularly susceptible to injury are those areas where the glove flexes, because at those locations, the protective padding is typically constructed such that it can bend or flex with a player's joint. However, such bending or flexing, such as at the wrist or knuckle area, can leave the player's joint exposed due to the bending away of the protective padding and, therefore, susceptible to injury.

Lacrosse gloves are well known for defenders and attack players. However, while lacrosse goalies have certain specialized equipment that satisfies the need of their position, lacrosse goalies typically wear substantially the same gloves as the defenders and forwards. The primary differences between the protective gloves worn by goalies and those worn by the other players on the field is that the lacrosse goalie gloves have a harder thumb portion and are therefore a little less flexible.

It is known, that a lacrosse goalie has different movements and responsibilities as compared to defenders or attack players. A lacrosse goalie in their role as defender of. a lacrosse goal, has two main purposes, one is to prevent an incoming lacrosse ball from entering the goal by catching and controlling it, and two, to deflect an incoming ball that is not caught and prevent it from entering the goal. It would therefore be desirable to provide improvements to lacrosse goalie gloves that can increase the goalie's ability to successfully deflect the incoming lacrosse balls.

SUMMARY OF THE INVENTION

It is therefore an advantage of the present invention to provide a lacrosse goalie glove that is configured to have a wider deflection area than current lacrosse gloves thereby assisting a lacrosse goaltender in the deflection of lacrosse balls away from a goal.

It is a further advantage of the present invention to provide a lacrosse goalie glove that allows for increased hand flexibility.

It is another advantage of the present invention to provide a lacrosse goalie glove with increased surface area as compared to current gloves in order to improve the ability to block a lacrosse ball.

Accordingly, in accordance with the above and the other advantages of the present invention, a lacrosse goalie glove is provided. The lacrosse goalie glove has a cuff portion for engaging at least a portion of a wearer's forearm. The cuff portion is coupled to a hand portion. The hand portion has a palm portion, an opposing backside portion, an inner side portion, and an outer side portion. The hand portion has a plurality of finger portions secured to and extending therefrom for receipt of a wearer's fingers. The hand portion has a thumb portion secured to and extending therefrom. The hand portion has a flange portion extending from the outer side portion thereof.

These and other features and advantages of the present invention will become apparent from the following description of the invention, when viewed in accordance with the accompanying drawings and appended claims.

DETAILED DESCRIPTION OF THE PREFERRED EMBODIMENT

Figure 1:
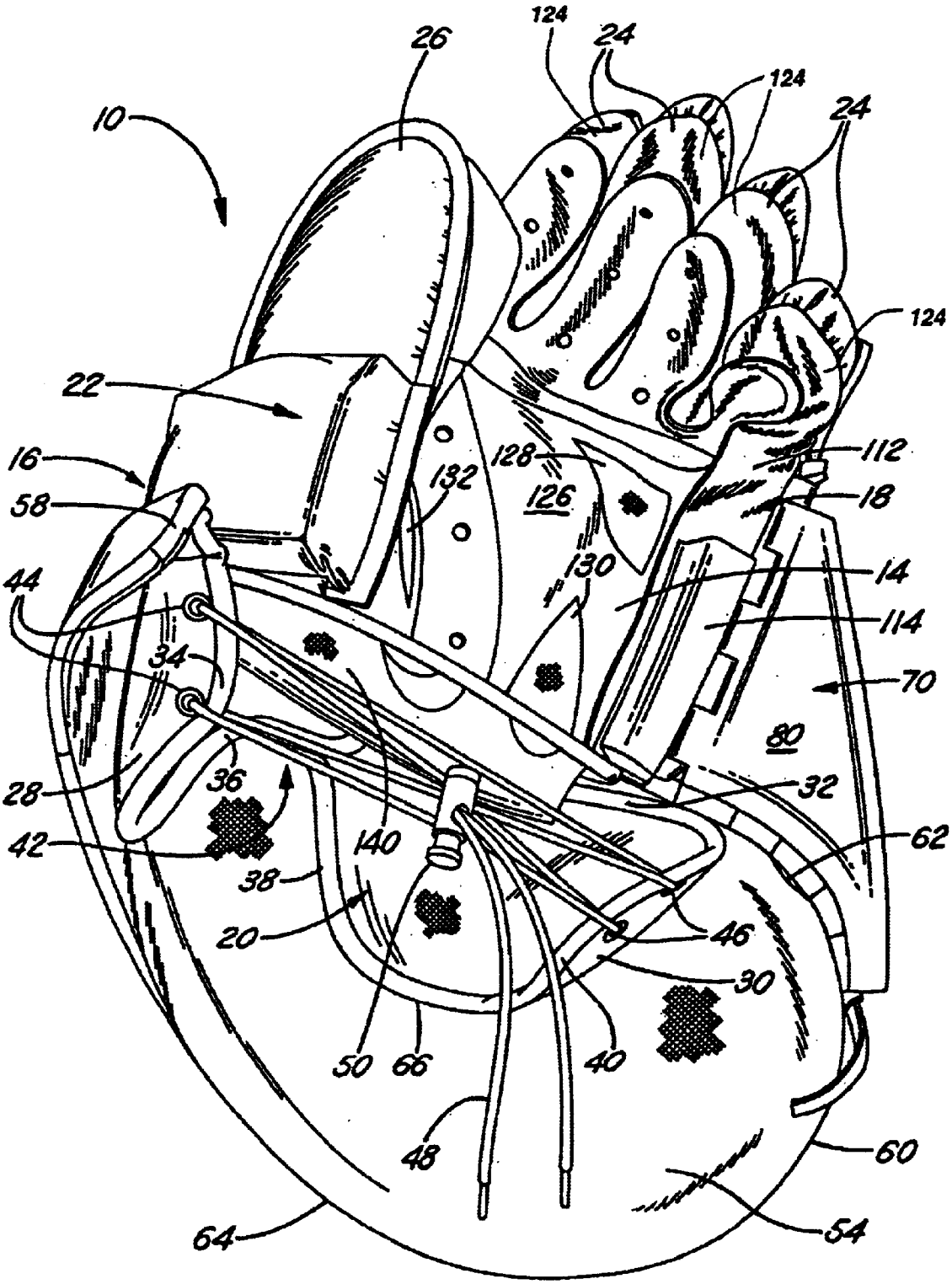
FIG. 1 is a palm side view of a lacrosse goalie glove in accordance with a preferred embodiment of the present invention.

Referring now to the Figures, which illustrate a lacrosse goalie glove 10 in accordance with the present invention. The drawings illustrate the left hand glove, however, it will be understood that the right hand glove has the same configuration, but opposite orientation. While the disclosed glove 10 is preferably for use in the game of lacrosse, it should be understood that the disclosed glove 10 may be used in a variety of other contact stick sports, including hockey. The glove 10 has a backside portion 12, an opposing palm portion 14, an inner side 16 (thumb side), and an outer side 18, which define an interior space for receipt of a wearer's hand. The glove 10 has a cuff portion 20, and a hand portion 22 coupled to the cuff portion 20. The hand portion 22 has a plurality of finger portions 24 extending therefrom. The hand portion 22 also has a thumb portion 26 extending therefrom.

Figure 2:
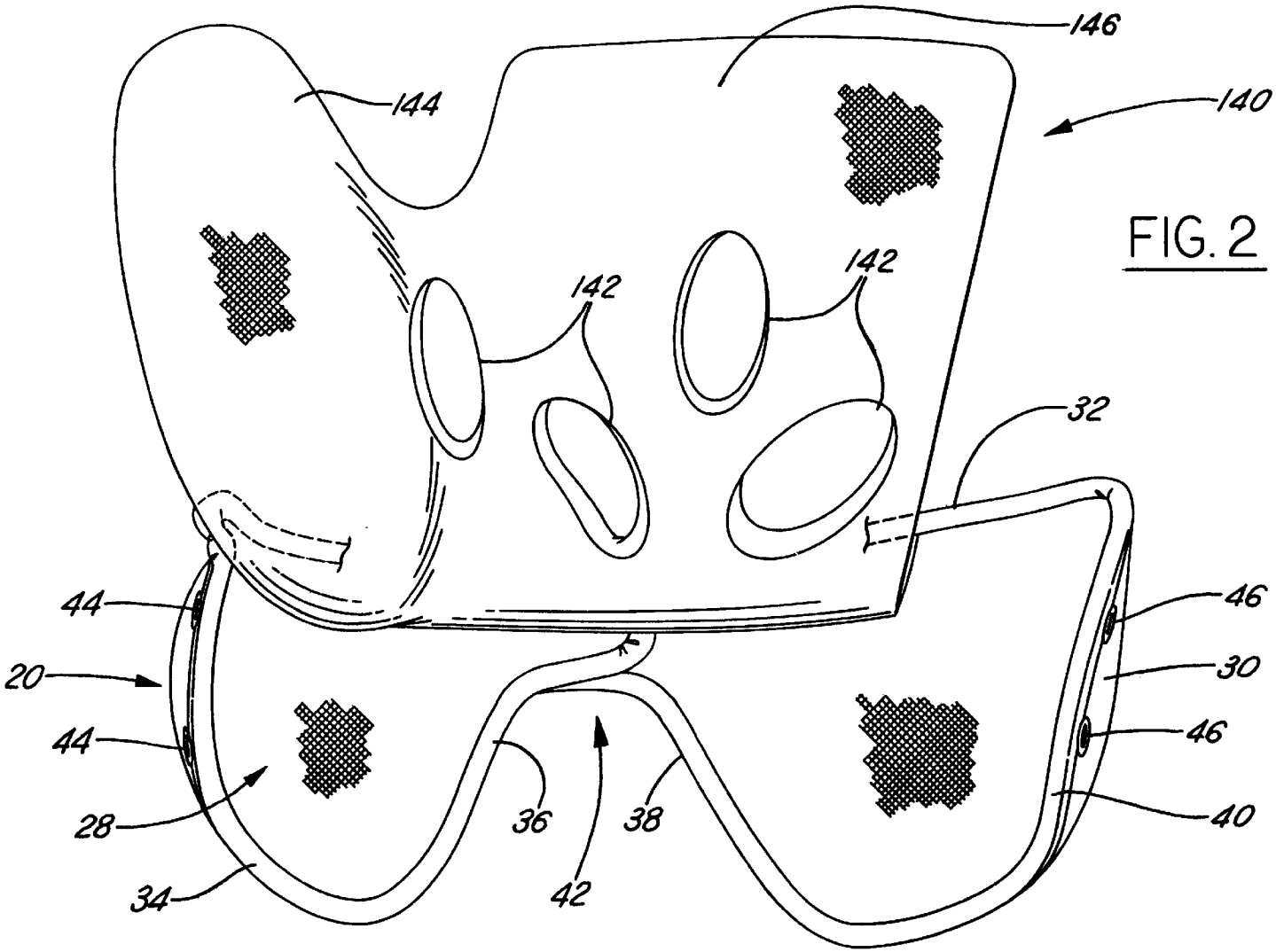
FIG. 2 is a schematic view from the palm side of a cuff portion and a spacer portion for a lacrosse goalie glove in accordance with a preferred embodiment of the present invention.
Figure 5:
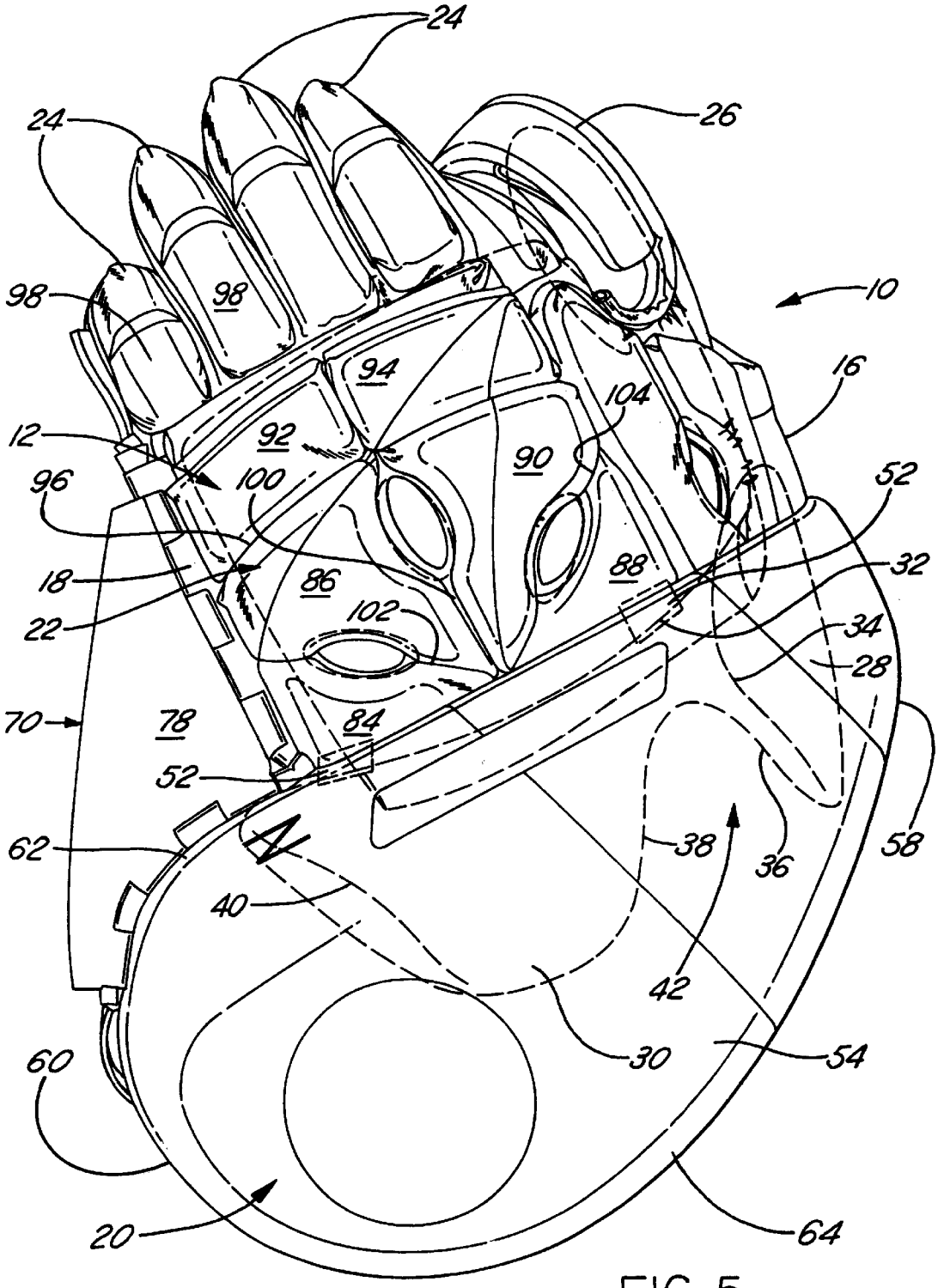
FIG. 5 is a backside view of a lacrosse goalie glove in accordance with a preferred embodiment of the present invention.

As shown in FIGS. 1, 2 and 5, the cuff portion 20 preferably has a first cuff portion 28 and an adjacent second cuff portion 30. The first cuff portion 28 and the second cuff portion 30 are secured at an upper border portion 32. The first cuff portion 28 has a first edge portion 34 and a second edge portion 36. The second cuff portion 30 has a first edge portion 38 and a second edge portion 40. The second edge portion 36 of the first cuff portion 28 overlaps the first edge portion 38 of the second cuff portion 30 to provide a split cuff. The first cuff portion 28 and the second cuff portion 30 are designed to cover and protect a user's wrist and forearm. Because the cuff portions 28, 30 are not affixed to each other along their adjacent edge portions 36, 38, but instead are each affixed to the upper border portion 32, they can move with respect to one another and therefore provide desired flexibility for a user's wrist as it moves during play. Additionally, the adjacent edge portions 36, 38 diverge from one another to form an opening 42 in the cuff portion 20, which allows even more flexibility for a user's wrist and therefore more unrestricted movement.

The first edge portion 34 of the first cuff portion 28 preferably has a first set of eyelets 44 formed therein. Similarly, the second edge portion 40 of the second cuff portion 30 has a second set of eyelets 46 formed therein. A lace 48 or other securing device is preferably passed through the first and second set of eyelets 44, 46 to connect the first cuff portion 28 to the second cuff portion 30 and surround a user's forearm when a user's hand is located in the interior space. As shown, the lace 48 is intended to pass around the underside of a user's forearm such that the tightness of the cuff portions 28, 30 with respect to a user's forearm may be adjusted. The lace 48 may be maintained in its desired position at a desired tightness through the use of a cord lock 50 or other similar locking device.

Figure 3:
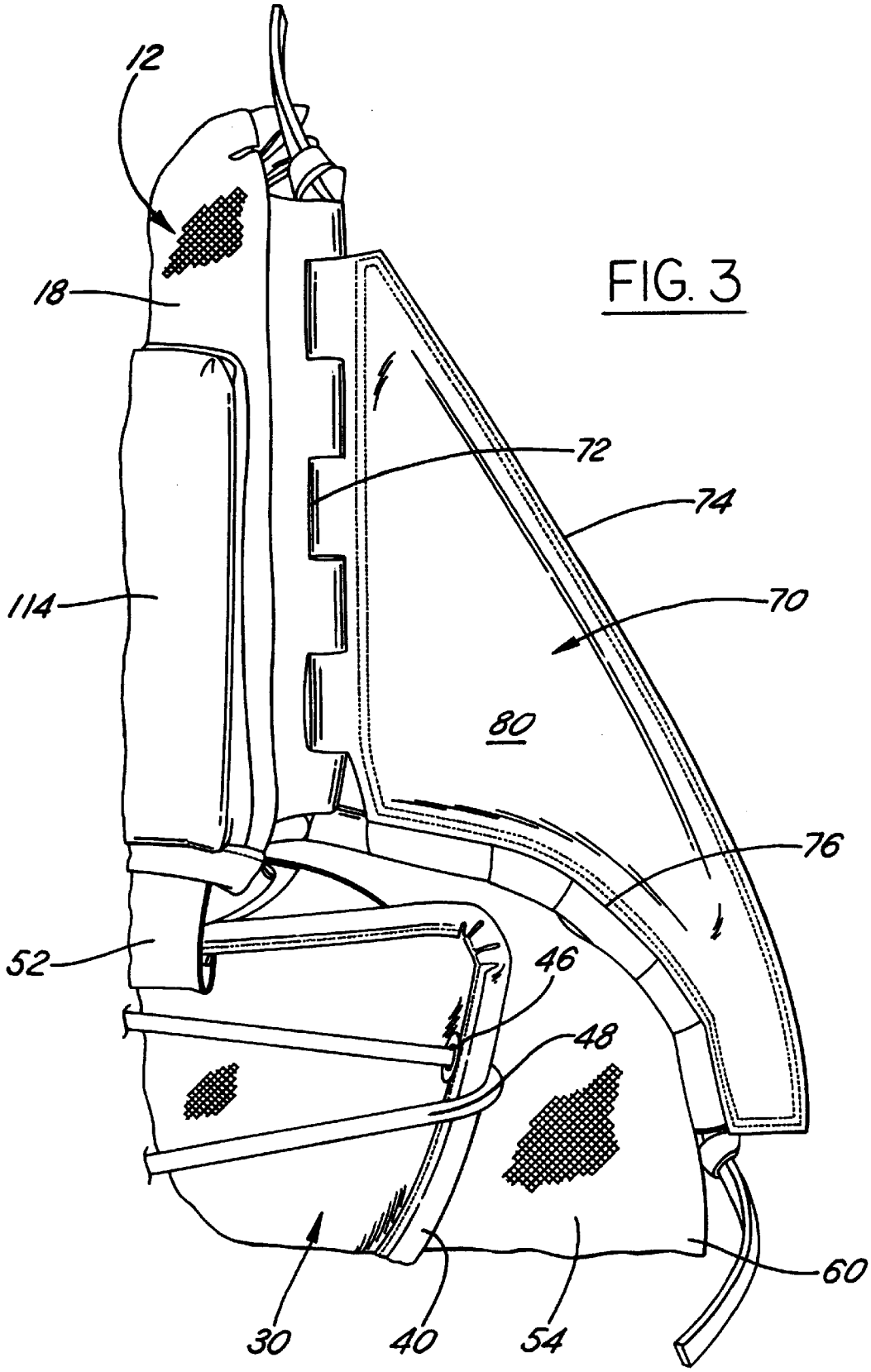
FIG. 3 is a schematic view from the palm side of a flange portion and an enlarged wrist guard of a lacrosse goalie glove in accordance with a preferred embodiment of the present invention.
Figure 4:
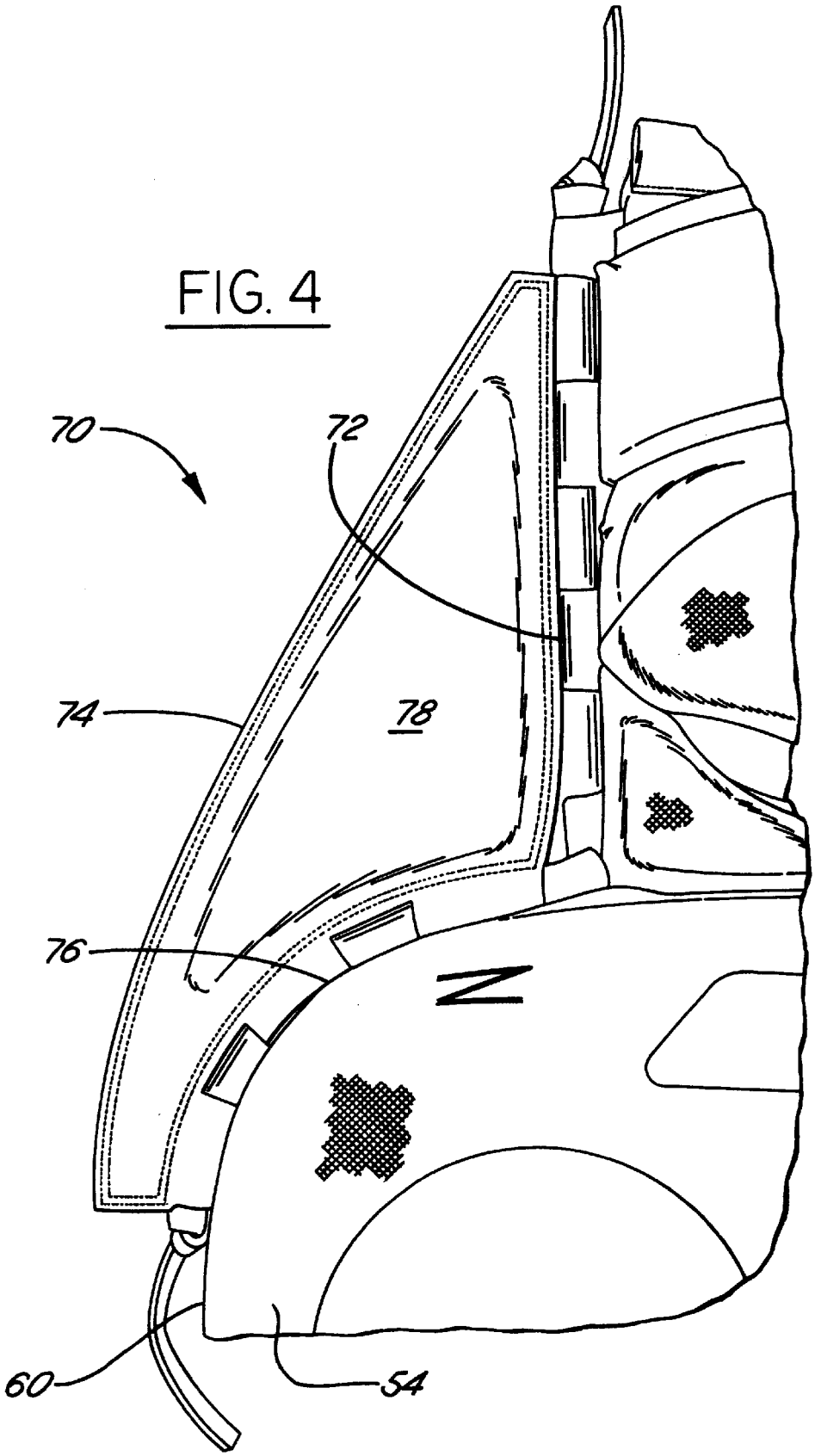
FIG. 4 is a schematic view from the back side of a flange portion and an enlarged wrist guard of a lacrosse goalie glove in accordance with a preferred embodiment of the present invention.

As best shown in FIG. 3, the cuff portion 30 is preferably secured to the hand portion 22 through a plurality of elastic members 52. Each of the elastic members 52 is preferably secured at one end to the upper border portion 32 of the cuff portion 20 and at an opposing end to the hand portion 22. This configuration keeps the cuff portion 20 secured to the hand portion 22, but the elastic members 52 allow the cuff portion 20 to move with respect to the hand portion 22 and provide flexibility as the user's hand flexes during play. The elastic members 52 are preferably disposed adjacent on either side 16, 18 of the hand portion 22 with a third elastic member 52 preferably disposed generally in the middle of the backside to provide additional strength and flexibility.

In the preferred embodiment, a wrist guard 54 is preferably disposed over a seam 56 located between the cuff portion 20 and the hand portion 22. The wrist guard 54 has a first end 58, which is preferably secured to the first cuff portion 28 adjacent the first edge portion 34. The wrist guard 54 has a second end 60 which preferably extends significantly beyond the second edge portion 40 of the second cuff portion 30. The wrist guard 54 also has an upper edge 62 and a lower edge 64. The upper edge 62 is located above the seam 56, while most if not all the lower edge 64 is located beneath the lowermost portion 66 of the cuff portion 20.

The wrist guard 54 is preferably oblong in shape such that the distance between the upper edge 62 and the lower edge 64 is greater at the second end 60 than the distance between the upper edge 62 and the lower edge 64 at the first end 58. The distance preferably generally increases from the first end 58 to the second end 60. Additionally, the distance between the lowermost portion 66 of the cuff portion 20 and the lower edge 64 preferably increases toward the second end 60. This configuration of the wrist guard 54 provides an enlarged area that is intended to contact a lacrosse ball and block its entry into the lacrosse goal with the largest area being located beyond the outer side 18. While the first and second ends 58, 60 of the wrist guard 54 are preferably secured to the cuff portion 20 by sewing. It should be understood that the ends 58, 60 may be attached by any other known securing means. Alternatively, the wrist guard 54 could instead be secured to the hand portion 22. The wrist guard 54 is also preferably coupled to the hand portion 22 by an elastic member to allow some relative movement therebetween.

The hand portion 22 has a flange portion 70 connected to and extending from its outer side 18. The flange portion 70 preferably has an inner edge 72 that is connected to the outer side 18 of the glove 10 and an outer edge 74 that is generally disposed from the inner edge 72. The flange portion 70 also has a lower edge 76 that is connected to the upper edge 62 of the wrist guard 54. The flange portion 70 has an outer surface 78 and an inner surface 80. The combination of the enlarged wrist guard 54 and the flange portion 70 provide an enlarged surface area to contact and block a lacrosse ball. The flange portion 70 many also be attached to the inner side 16 of the glove.

The hand portion 22 extends between the seam 56 and the plurality of finger portions 24. The backside portion 12 preferably has plurality of protected padded portions secured thereto. As shown, the backside portion 12 is preferably subdivided into a plurality individual protective padded portions 84, 86, 88, 90, 92, 94. The backside portion 12 of the glove 10 has a first lengthwise cut 96, i.e., from the inner side 16 to the outer side 18 of the hand portion 22, which allows the glove to flex along the lengthwise cut 96 as a user's hand moves. Specifically, the lengthwise cut 96 is cut so that the protective padded portions 92 and 94 are moveable with respect to the adjacent protective padded portions 86 and 90.

The finger portions 24 are moveable with respect to the padded portions 92 and 94 allowing a user's fingers to flex. Each of the finger portions 24 also has a protective pad 98 thereon. Additionally, the backside portion 12 has a cut 100 that extends generally from the seam 56 to the finger portions 24. The cut 100 allows the protective padded portions 84, 94 to move with respect to the protective padded portions 90, 92, allowing the glove to bend around an axis defined by the cut 100. The cut 100 allows the glove to fit more comfortably as it allows the glove to better. conform to a user's hand as he or she closes their hand around a stick and, therefore, providing a tighter shape. This is necessary as the back of a typical user's hand is not flat, and the padded protected portions are not flexible enough to bend without the cut portion 100.

The backside portion 12 of the hand portion 22 preferably has a pair of opposing angled cuts 102, 104. The angled cuts 102, 104 similarly assist the glove 10 in conforming to the user's hand as the protective padded portions 84, 88 can each independently move with respect to the other padded portions as a user's hand flexes during play, thus providing a better fitting glove. The cuts are preferably formed in the glove 10 through die cutting or other known cutting or forming means, which are sufficient to configure the backside portion 12 of the glove to conform to the configuration described above. The backside portion 12 may have a variety of additional or different cuts as desired.

The backside portion 12 of the hand portion 22 has a plurality of vent openings formed therein to provide ventilation to a user's hand. A first vent opening 106 is preferably disposed along the cut 100 between the protective padded portion 86 and the protective padded portion 90. A vent opening 108 is preferably disposed along the first angled cut 102 between the protective padded portion 88 and the protective padded portion 90. Another vent opening 110 is preferably disposed along the second angled cut 104 between protective padded portions 84, 86. The vent openings 106, 108, 110 are located along the die cuts, which do not correspond to joints of a user's hand and, therefore while there is some relative movement of the protective pads in which the vent openings are formed, the movement is not sufficient to cause a portion of a user's hand to be exposed. It should be understood that while three vent openings are disclosed on the backside portion 12 of the glove 10, any number of vent openings may be utilized. Additionally, the vent openings may be disposed in a variety of other locations along the backside portion 12 in accordance with the preferred embodiment, including within the respective individual padded portions themselves, instead of along the die cuts.

The inner side 16 and the outer side 18 of the hand portion 22 connect the backside portion 12 to the palm portion 14.

The inner side 16 has the thumb portion 26 extending therefrom. The outer side 18 of the glove preferably has a mesh layer 112 extending between the backside portion 12 and the palm portion 14 with a protective padded portion 114 secured thereon. The inner side 16 of the glove also has a protected padded portion that is sub-divided into a first padded portion 116 and a second padded portion 118 by a die cut 120 formed therein. A side vent opening 122 is preferably formed along the cut 120 between the first padded portion 116 and. the second padded portion 118 of the inner side 16 of the glove 10.

FIG. 1 illustrates the palm portion 14 of the lacrosse glove, in more detail. The palm portion 14 extends from the lower edge of the hand portion 22 adjacent the seam 56 to the tips of the finger portions 24 and the tip of the thumb portion 26. The palm portion 14 is attached to each of the respective padded portions 98 of each finger portion 24 by a mesh layer 124. The mesh layer 124 allows for flexibility of the fingers within the finger portions 24 as well as to provide sufficient ventilation through the mesh layer 124 to a user's fingers. As shown, the palm portion 14 is preferably comprised of a durable material such as leather, a synthetic material, or any other known suitable material, generally illustrated by reference number 126. Mesh Dortions 128, 130, 132, and 134 are preferably located throughout the palm portion 14 to provide ventilation to a user's palm. The mesh portions are located in the palm portion 14 in areas that are not intended as primary contact areas for a stick. This is contrary to prior gloves that provide much larger mesh portions on the palm portion, which tend to wear and rip and thus render the glove illegal.

As shown in FIG. 2, the glove 10 preferably has a flap portion 140 which is secured to the rear side of the cuff portion 20 and can move into and out of the interior portion of the glove. The flap portion 140 is shown in an inserted position inside the glove in FIG. 1 and is shown in a withdrawn position in FIG. 2. The flap portion 140 when in the inserted position, is designed to provide a better fit for the user's hand by taking up any excess space between the back of the user's hand and the underside of the hand portion 22. The flap portion 140 has a plurality of openings 142 formed therein, which correspond to a respective vent opening formed in the backside portion 12 and the inner side 16 of the glove 10. The flap portion 140 is preferably comprised of a foam or padded material so as to further protect the back of a user's hand from contact with a stick. As the flap portion 140 spans the seam 56 in the inserted position, it also assists the wrist guard 54 in preventing the back of a user's forearm or wrist from being exposed to contact with a stick. The flap portion 140 has a thumb portion 144 which preferably extends into the thumb portion 26 of the glove 10 to help to provide a better fit in the thumb portion and a palm portion 146 that helps provide a better fit for the hand.

While particular embodiments of the invention have been shown and described, numerous variations or alternate embodiments will occur to those skilled in the art. Accordingly, it is intended that the invention be limited only in terms of the appended claims.

What is claimed is:

1. A protective sports glove, comprising:

a cuff portion for engaging at least a portion of a wearer's forearm;

a hand portion having a palm portion and an opposing backside portion with a plurality of protective padded portions, said hand portion coupled to said cuff portion and having an inner side and an outer side;

a plurality of finger portions secured to and extending from said hand portion for receipt of a wearer's fingers therein; and a flange portion secured to the glove and extending generally outwardly away from the sports glove;

whereby said flange portion lies in generally the same plane as said opposing backside portion.

2. The gloves of claim 1, wherein the protective sports glove is a lacrosse goalie glove.

3. The glove of claim 2, wherein said hand portion is elastically coupled to said cuff portion.

4. The glove of claim 2, further comprising:

a thumb portion secured to and extending from said hand portion.

5. The glove of claim 4, wherein said thumb portion includes a rigid protective portion to protect the wearer's thumb.

6. The glove of claim 1, further comprising:

a plurality of vent openings formed in said backside portion of said hand portion.

7. The glove of claim 2, wherein said palm portion is primarily comprised of a durable material with a plurality of mesh portions interspersed therein in areas that are not intended to contact a stick.

8. The glove of claim 2, further comprising:

a wrist guard coupled to said hand portion.

9. The glove of claim 8, wherein said wrist guard extends beyond said hand portion of the glove and is intended to block an incoming lacrosse ball.

10. The glove of claim 1, wherein said flange portion is connected to and extends from said outer side of the sports glove.

11. The glove of claim 10, wherein a wrist guard is coupled to said hand portion and extends beyond said outer side of the sports glove.

12. A lacrosse goalie glove comprising:

a palm side for contacting a lacrosse stick;

a backside having a plurality protective pads disposed thereon;

an enlarged area extending away from said backside for contacting and blocking a lacrosse ball;

a cuff portion for contacting at least a portion of a wearer's wrist;

a hand portion coupled to said cuff portion and having an inner side and an outer side that each extend between said palm side and said backside;

a plurality of finger portions secured to and extending from said hand portion; and a wrist guard coupled to said backside of the glove, wherein said wrist guard has a first end adjacent said inner side and a second end adjacent said outer side and wherein said second end extends beyond said outer side in a generally planar manner to act as a shield to block a lacrosse ball.

13. The glove of claim 12, wherein said enlarged area extends outwardly beyond said outer side of the glove.

14. The glove of claim 12, wherein said enlarged area includes a flange portion extending from said outer side of the glove.

15. The glove of claim 12, wherein said second end of said wrist guard is larger than said first end.

16. A lacrosse goalie glove comprising:

a hand portion including a palm portion and a back portion, said back portion having a protective padding formed thereon;

a cuff portion coupled to said hand portion;

a wrist guard coupled to said hand portion and generally overlying a portion of said cuff portion and said hand portion;

a plurality of finger portions secured to and extending from said hand portion; and an enlarged area extending away from glove for contacting and blocking a lacrosse ball, said enlarged area having an outer edge with said outer edge being located further outwardly from the glove adjacent said cuff portion than adjacent said plurality of finger portions.

17. The glove of claim 16, wherein said enlarged area extends from an outer side of the glove.

18. The glove of claim 16, wherein said enlarged area has a first portion and a second portion.

19. The glove of claim 18, wherein said first portion of said enlarged area has an inner edge which is secured to a side of the glove.

20. The glove of claim 19, wherein said first portion of said enlarged area is secured to said side of the glove such that it lies in generally the same plane as said back portion.

21. The glove of claim 20, wherein said second portion of said enlarged area includes an outer side of said wrist guard which extends further outwardly from an outer side of the glove than an inner side of said wrist guard extends from an inner side of the glove.

22. The glove of claim 20 wherein said wrist guard includes a lower edge that extends below a lower edge of said cuff portion to provide additional area to block an incoming lacrosse ball.

23. The glove of claim 19, wherein said first portion of said enlarged area has a lower edge which is secured to said second portion of said enlarged area.

24. The glove of claim 23, wherein said first portion of said enlarged area is generally triangular in shape.

25. The glove of claim 16, wherein said enlarged portion is constructed of a relatively rigid material.

26. A protective sports glove, comprising:

a cuff portion for engaging at least a portion of a wearer's forearm;

a hand portion having a palm portion and an opposing backside portion with a plurality of protective padded portions, said hand portion coupled to said cuff portion and having an inner side and an outer side;

a plurality of finger portions secured to and extending from said hand portion for receipt of a wearer's fingers therein; and a generally rigid flange portion secured to a side of said hand portion and extending generally outwardly therefrom for contacting a blocking a lacrosse ball.

27. The glove of claim 26 wherein said sports glove is a lacrosse goalie glove.

28. The glove of claim 27, further comprising:

a wrist guard coupled to said hand portion.

29. The glove of claim 28, wherein said wrist guard has one end that extends beyond said outer portion of the glove and is intended to block an incoming lacrosse ball, said one end extending outwardly such that it is parallel to said backside portion of said hand portion.

30. The glove of claim 29, wherein said one end of said wrist guard is secured to said rigid flange portion.

31. The glove of claim 27, wherein said glove includes a plurality of vent openings formed in said backside portion of said hand portion.

32. A sports glove comprising:

a hand portion having a palm portion;

a back portion opposing said hand portion and comprising an upper portion, a lower portion, a first edge and a second edge;

at least one finger portion secured to and extending from said upper portion;

a thumb portion secured to and extending from said first edge of said hand portion;

a wrist portion coupled to said lower portion; and a rigid flange hingeably coupled to said second edge and adapted to deflect a force applied thereto.

33. The sports glove of claim 32, wherein said thumb portion is rigid.

34. A sports glove comprising:

a hand portion having a palm portion;

a back portion opposing said hand portion and comprising an upper portion, a lower portion, a first edge and a second edge;

a thumb portion secured to and extending from said first edge;

a wrist portion coupled to said lower portion; and at least one finger portion secured to and extending from said upper portion;

a deflection portion coupled to said second edge and extending therefrom, said deflection portion further coupled to said lower portion and extending therefrom.

35. The sports glove of claim 34, wherein said thumb portion is rigid.

36. A sports glove comprising:

a hand portion having a palm portion;

a back portion opposing said hand portion and comprising an upper portion, a lower portion, a first edge and a second edge;

a thumb portion secured to and extending from said first edge;

a wrist portion coupled to said lower portion; and at least one finger portion secured to and extending from said upper portion;

a deflection portion coupled to said lower portion and extending therefrom, wherein a surface area of said deflection portion is greater than a surface area of said wrist portion.

37. The sports glove of claim 36, wherein said thumb portion is rigid.

* * * * *